US005855753A

United States Patent [19]

Trau et al.

[11] Patent Number: 5,855,753

[45] Date of Patent: Jan. 5, 1999

[54] METHOD FOR ELECTROHYDRODYNAMICALLY ASSEMBLING PATTERNED COLLOIDAL STRUCTURES

[75] Inventors: Mathias Trau; Ilhan A. Aksay; Dudley A. Saville, all of Princeton, N.J.

[73] Assignee: The Trustees of Princeton University, Princeton, N.J.

[21] Appl. No.: 756,023

[22] Filed: Nov. 26, 1996

[51] Int. Cl.[6] ..... C25D 13/12

[52] U.S. Cl. ..... 204/484; 204/492

[58] Field of Search ..... 204/484, 485, 204/492, 497, 622, 490; 205/109

[56] References Cited

U.S. PATENT DOCUMENTS

| | | | |
|---|---|---|---|
| 5,002,647 | 3/1991 | Tanabe et al. | 204/484 |
| 5,128,006 | 7/1992 | Mitchell et al. | 204/490 |

OTHER PUBLICATIONS

Richette et al., "Electric Field Effects in Polyball Suspensions", 387–411 (no date available).

Giersig et al., "Preparation of Ordered Colloid Monolayers by Electrophetic Deposition", Langmuir, vol. 9, No. 12, 1993, pp. 3408–3418. (no month available).

*Primary Examiner*—Kathryn L. Gorgos
*Assistant Examiner*—Kishor Mayekar
*Attorney, Agent, or Firm*—Friscia & Nussbaum

[57] ABSTRACT

A method apparatus is provided for electrophoretically depositing particles onto an electrode, and electrohydrodynamically assembling the particles into crystalline structures. Specifically, the present method and apparatus creates a current flowing through a solution to cause identically charged electrophoretically deposited colloidal particles to attract each other over very large distances (<5 particle diameters) on the surface of electrodes to form two-dimensional colloidal crystals. The attractive force can be created with both DC and AC fields and can modulated by adjusting either the field strength or frequency of the current. Modulating this "lateral attraction" between the particles causes the reversible formation of two-dimensional fluid and crystalline colloidal states on the electrode surface. Further manipulation allows for the formation of two or three-dimensional colloidal crystals, as well as more complex "designed" structures. Once the required structures are formed, these three-dimension colloidal crystals can be permanently "frozen" or "glued" by controlled coagulation induced by to the applied field to form a stable crystalline structure.

9 Claims, 6 Drawing Sheets

METHOD FOR ELECTROHYDRODYNAMICALLY ASSEMBLING PATTERNED COLLOIDAL STRUCTURES

The present invention has been made under a contract by the United States Air Force Office of Scientific Research and the Microgravity Science and Applications Division of NASA and the government may have certain rights to the subject invention.

BACKGROUND OF THE INVENTION

1. Field of the Invention

This invention generally relates to a method and apparatus for the electrohydrodynamic assembly of two- and three-dimensional colloidal crystals on electrode surfaces.

2. Related Art

The construction of materials with structural features existing on the 1–1000 nanometer (nm) size scale, is a rapidly emerging area in materials science. Such nanostructured materials, particularly multilayered thin film composites known as nanolaminates, exhibit remarkably different macroscopic properties than those of more conventionally engineered materials having structural features in the micrometer size range or greater. Examples of these nanostructured materials include metal-metal and ceramic-metal compositionally modulated nanolaminates for applications as diverse as high temperature gas turbine jet engines, soft x-ray and extreme ultraviolet mirrors, as well as magnetic materials for high-density magnetic recording and magneto-optical data storage and retrieval.

Moreover, it is known that nested levels of structural hierarchy in composite materials can impart vastly superior properties over homogeneously structured materials. Such design features are readily exploited in biological materials (e.g., bone, abalone shell, deer antler and muscle tissue) where subtle differences in structure, over various length scales, give rise to superior performance characteristics.

Although nanostructured materials display considerable potential, their development is currently limited the inability to conveniently and economically assemble such materials in large quantities, preferably under ambient conditions. Due to the intrinsic dimensional limitations of mechanical forming, pattern formation in man-made materials has heretofore been restricted to length scales larger than a few tens of microns. Nanolaminates have been produced by molecular deposition techniques, which utilize individual molecules as building blocks to form higher order structures, but these procedures are cumbersome, costly and usually only produce small quantities of material.

Another process for assembling designed structures is by electrophoretic deposition. The phenomenon of electrophoresis was first observed in 1807 by F. F. Ruess (*Mem. Soc. Imp. Natuv. Mouscou,* 1809, 2, 327) by passing an electric current through a suspension of clay in water, the clay particles immigrating towards the anode. Electrophoretic deposition of colloidal particles at electrodes has been used as a manufacturing technique for coating metal compounds. Metals, oxides, phosphores, inorganic and organic paints, rubber, dielectrics, superconductors and glasses have all been deposited via this technique using both aqueous and non-aqueous media. However, work in this area has been concerned with measuring the deposition rate, and achieving the maximum thickness and porosity of these films. By contrast, little attention has been devoted to the microscopic dynamics that give rise to the resulting morphology of the deposited layer. Indeed, it has generally been assumed that the dynamics of particle layer formation in these systems are identical to those which occur during particle sedimentation. This has been described by Hamaker, H. C. and Verwey E. J. W. (*Trans. Faraday Soc.* 1940, 36, 80) as resembling the force of gravity on particles in a container. Moreover, it has also been generally assumed that electrophoretically deposited layers are highly porous, resulting from a high degree of colloidal coagulation with the electrode which leads to poor packing efficiencies. Additionally, a key problem is the control of layer thickness.

The assembly of colloids into crystalline structures has heretofore been achieved by dispersing monosized colloids into solvent and manipulating either particle-particle interaction forces or entropic effects. The formation of these types of crystalline structures has proved to be difficult to regulate externally and cumbersome to confine to two dimensions. Similarly, protein crystallization has also proved to be difficult to regulate and is currently the ratio-determining step in the structure determination of biologically important proteins.

F. Richetti, J. Prost and N. A. Clark, in Electric Field Effects in Polyball Suspensions, examined the attractive reaction when an AC electric field induces motion between like charged polystyrene spherical "balls" to form two-dimensional particle clusters. While the explanation for the particle behavior acknowledges a lack of a detailed understanding, it does express a belief that the attractive force is frequency dependent. At low frequencies, the particle interactions are found to involve the field induced motion of the small counterion clouds surrounding each polystyrene ball as well as the electrohydrodynamic flow of the suspending fluid. At frequencies above a few kilohertz, the particles seem to attract each other via induced dipole fields.

Langmuir 1993, 9 3408,3413, M. Geirsig and P. Mulvaney, in preparation of ordered colloid monolayers by electrophoretic deposition discussed electrophoretic deposition and its usefulness as a technique for examining the surface chemistry of an ordered, gold colloidal monolayer. Micrographs indicate that an ordered monolayer, formed by electrophoretic deposition at field strengths of less than 1 volt per centimeter, is in fact built up of a large number of smaller crystalline domains, each domain containing 50 to 200 particles in the form of hexagonally closely packed colloidal particles. Transmission electron microscopy reveals that "grain boundaries" tend to form at particles which are either aspherical or too large to fit into the lattice and that such grain boundaries limit the formation of monolayers because they exacerbate the tendency of the monolayers to tear as they are removed from the aqueous solution after deposition.

None of the previous efforts in this field disclose all of the benefits of the present invention, nor does the prior art teach or suggest all of the elements of the present invention.

OBJECTS AND SUMMARY OF THE INVENTION

It is a primary object of the present invention to provide an electrohydrodynamic method and apparatus for forming colloidal arrays with designed structures at length scales down to the individual particle size.

It is also an object of the present invention to provide an electrohydrodynamic method and apparatus for controlling the particle arrangement of a patterned colloidal array.

It is also an object of the present invention to provide an electrohydrodynamic method and apparatus for laterally manipulating electrophoretically deposited colloidal particulate matter to form a crystalline structure.

It is another object of the present invention to provide an electrohydrodynamic method and apparatus that makes use of a lateral attraction force, which exists near electrode surfaces in the presence of an applied electric field, between like charged particles that have been electrophoretically deposited on the surface of an electrode, for forming crystalline structures.

It is still even another object of the present invention to provide an electrohydrodynamic method and apparatus in which the lateral attraction force between particles can be modulated by adjusting electric field strength, and/or the frequency of the electric field.

It is another object of the present invention to provide an electrohydrodynamic method and apparatus for forming two-dimensional colloidal crystals for both micrometer and nanometer-sized particles that have been electrophoretically deposited on the surface of an electrode.

It is another object of the present invention to provide an electrohydrodynamic method and apparatus for electrophoretically depositing and assembling layered crystalline structures.

It is still another object of the present invention to provide an electrohydrodynamic method and apparatus for assembling colloidal crystals which have a designed microscopic architecture.

It is still another object of the present invention to provide an electrohydrodynamic method and apparatus for electrophoretically depositing and assembling colloids which overcomes the dimensional limitations of mechanical forming to achieve pattern formation in man-made materials that is smaller than a few tens of microns.

It is still another object of the present invention to provide an electrohydrodynamic method and apparatus which is capable of mass producing patterned colloidal structures and arrays according to economies of scale.

These and other objects are achieved by the present invention which comprises a method and apparatus for electrophoretically depositing, and for electrohydrodynamically assembling colloidal crystals and more complicated structures. The colloidal crystal formed from this electrohydrodynamic methodology is typically a nanostructure having a near uniform structural morphology. Specifically, the present method and apparatus creates a current flowing through a solution to cause identically charged electrophoretically deposited colloidal particles to attract each other over very large distances (<5 particle diameters) on the surface of electrodes to form two-dimensional colloidal crystals. The attractive force can be created with both DC and AC fields and can modulated by adjusting either the field strength or frequency of the current. Modulating this "lateral attraction" between the particles causes the reversible formation of two-dimensional fluid-like and crystalline colloidal states on the electrode surface. Further manipulation allows for the formation of two or three-dimensional colloidal crystals, as well as more complex "designed" structures. Once the required structures are formed, these three-dimension colloidal crystals can be permanently "frozen" or "glued" by controlled coagulation induced by to the applied field to form a stable crystalline structure.

BRIEF DESCRIPTION OF THE DRAWINGS

Other important objects and features of the invention will be apparent from the following Detailed Description of the Invention when read in context with the accompanying drawings in which.

DETAILED DESCRIPTION OF THE INVENTION

Figure 1:
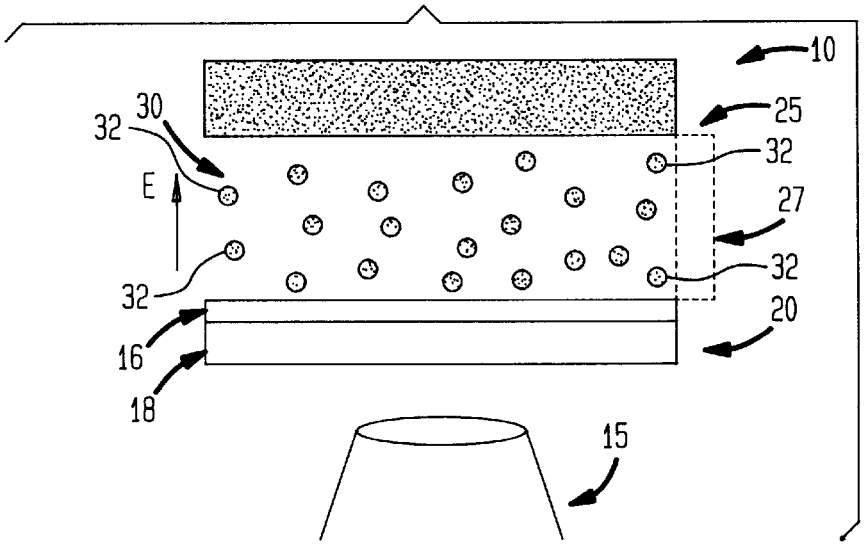
FIG. 1 is a schematic view of the apparatus of the present invention.

FIG. 1 is schematic view of an electrohydrodynamic apparatus, generally indicated at 10, for use in practicing the present invention. The apparatus shown in FIG. 1 comprises an optically transparent indium in oxide (ITO) electrode 20 coupled to an optical microscope 15. While a transparent ITO electrode can be used to permit visual observance of crystal structures formed thereon, the present invention can be practiced with any electrode material. A thin vapor deposited film of indium tin oxide 16 on a glass microscope coverslip 18 forms the anode 20 and a piece of polished brass, or other suitable conductive material, forms the cathode electrode 25. The anode electrode 20 and cathode electrode 25 are separated by an insulating Teflon spacer 27. A dilute suspension fluid 30 containing particulate 32 is placed between the anode and cathode electrodes 20 and 25. As will be hereinafter described in detail, a weak electric field E electrophoretically deposits the particles 32 onto the anode 20. Increasing the electric field causes the particles, 20 to aggregate into crystals. Further increasing the electric field E coagulates the assembled particles 32 permanently into place, that is, the particles are permanently adhered either to the electrode surface or to each other after this treatment.

FIGS. 2 *a–f* show two examples of such electrophoretic deposition onto the ITO anode. FIGS. 2 *a–c* show a sub-monolayer, electrophoretically deposited film of silica particles 42, each have a diameter of proximately 900 nm. FIGS. 2 *d–f* show a sub-monolayer, electrophoretically deposited film of polystyrene particles 52, each having a diameter of approximately 2 $\mu$m. Both films consist of particles which have been deposited onto the ITO anode electrode from a dilute suspension fluid which is triply distilled water (pH=5.8, less than 1 $\mu$S $cm^{-1}$ conductivity) and in the polystyrene case, the dilute suspension fluid contains a mixture of ionic and non-ionic surfactants added to optimize the colloidal stability of these particles. The two-dimensional "gaseous" structures shown in FIGS. 2 *a* and 2*d* are formed either by applying a weak electric field (e.g., 0.5 V) across the dilute suspension, or by allowing the colloidal particles to sediment onto the anode electrode. In both cases, the particles do not adhere to the surface of the anode, but rather continue moving in two-dimensions via Brownian agitation. With an electric field applied, the two-dimensional mobility of these negatively charged particles on the surface of the anode electrode is a consequence of steric stabilization of the particles with respect to the anode electrode. Regarding the second suspension, the two-dimensional mobility is provided by the surfactant layer on the surface of the polystyrene particles. For silica particles, where there is no surfactant component of the dilute suspension fluid, the silica particles remain stable because of the presence of polysilicate moieties at the silica/aqueous solution interface. The existence of such polysilicate moieties, known as "stubble hair," on the silica surface causes a short range repulsive force between oxide surfaces.

Increasing the strength of the applied voltage (e.g. from 0.5 to 1.5 V) reveals a surprising result. In the presence of a sufficiently strong applied electric field, the negatively charged silica (as well as polystyrene) particles are observed to attract each other on the surface of the anode electrode. This "lateral attraction force" acts in a direction normal to the applied electric field and is sufficiently strong enough to bring the negatively charged particles together to form stable two-dimensional colloidal crystals 44 and 54, as shown first in FIGS. 2*b* and 2*e* and as further shown in FIGS. 2*c* and 2*f*.

At electric field strengths between 50–100 V $cm^{-1}$ (1–2 applied volts), the formation of these colloidal crystals is entirely reversible. When the applied electric field is removed, the negatively charged particles are immediately randomized by Brownian agitation to form two-dimensional "gaseous" structures similar to the ones shown in FIGS. 2*a* and 2*d*. The magnitude of the lateral attraction force between the negatively charged particles can be modulated by the amplitude of the applied electric field. The ability to modulate the strength of this interaction allows the formation of different two dimensional colloidal phases on the surface of the anode electrode, for example, gaseous, liquid and crystalline phases. Phase transitions can be easily induced by varying the ionic current which passes through the cell.

The lateral attraction force also acts when an AC voltage is applied between the cathode electrode 25 and the anode electrode 20. Very similar two-dimensional colloidal phase transitions are observed when the amplitude of the applied AC voltage is gradually increased. This colloidal particle behavior is observed for all frequencies below approximately 1 MHZ, above which the lateral attraction force disappears.

Figure 3:
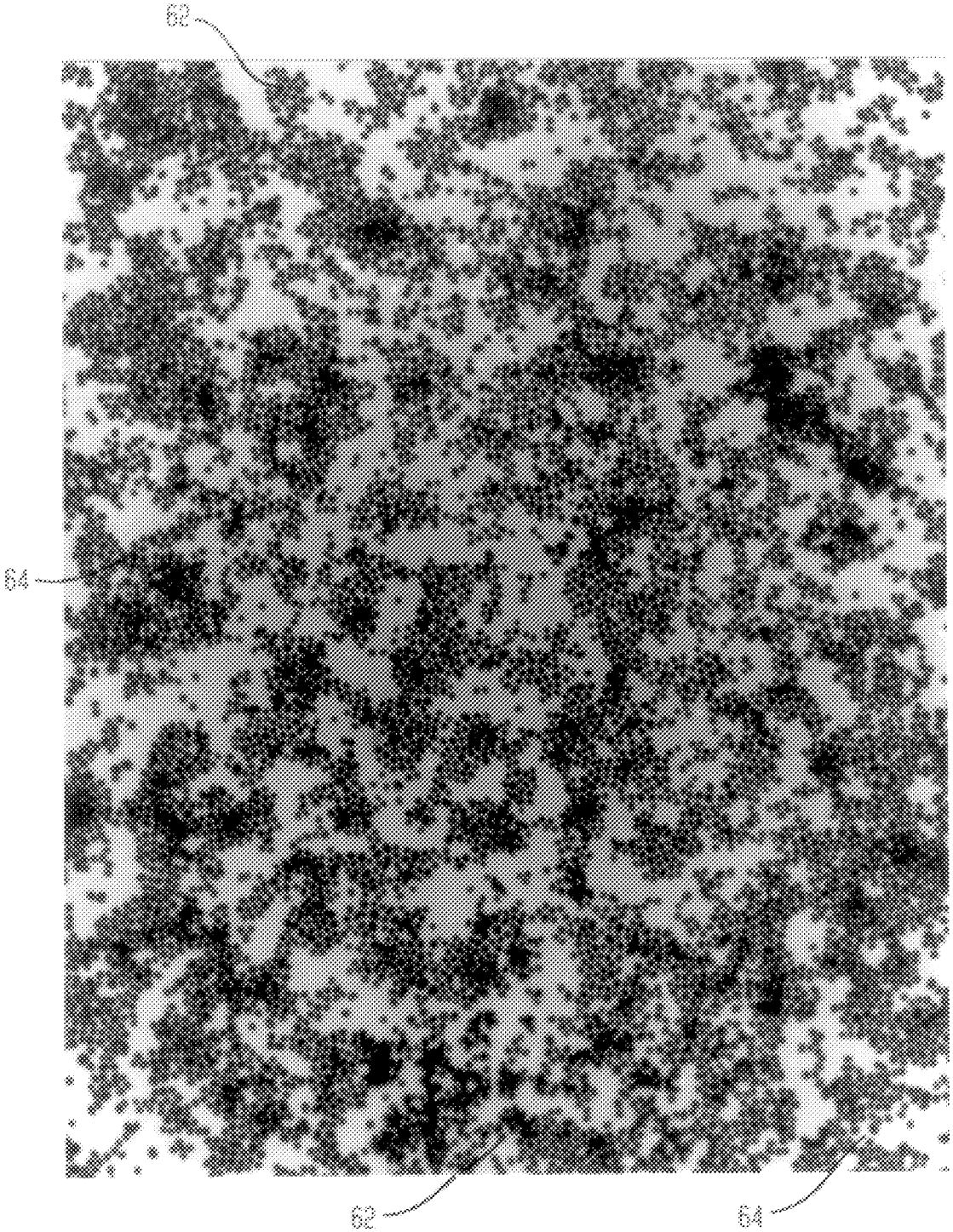
FIG. 3 shows clustered gold particles created by the method and apparatus of the present invention.

Similar results have been observed for the deposition of nanosized particles which are so small that imaging by transmission electron microscopy is required. Referring to FIG. 3, gold particles 62 which were synthesized having a particle diameter of 16 nm, were electrophoretically deposited onto a carbon-coated electron microscope grid by application of a field of 0.3 $Vcm^{-1}$ for 300 s. 55. FIG. 3 shows a typical example of a submonolayer film of particles formed in this way. The formation of 2D cluster 64, similar to those shown in FIG. 2, reveals the existence of a lateral attraction operating in a manner similar to that observed for larger particles. Extensive 2D clustering of these gold particles 62 is not possible through capillary aggregation mechanisms that occur during drying, as these mechanisms result in patchy, more irregular structures. Control experiments, with no applied field, have confirmed this result. Lateral attraction between electrophoretically deposited particles is thus a general phenomenon that operates for any colloidal material which remains colloidally stable at the electrode/solution interface during the deposition process.

The lateral attraction force between electrophoretically deposited particles at the surface of the anode electrode is extremely surprising given the strong repulsion expected from purely electrostatic considerations. All of these particles are similarly charged and contain a diffuse ion cloud, which is polarized in the presence of an electric field. As these particles approach each other on the surface of the anode electrode, electrostatic repulsion should be experienced both from monopole and dipole interactions. Instead, the observed attraction between these particles is clearly not the result of a purely electrostatic interaction. As experimentation has shown, the lateral attractive force is strong enough to overcome the electrostatic repulsion. Accordingly, it must be concluded that the observed lateral attractive force results from the passage of ionic current through the solution. The currents in this system have been to measured be between 1–500 $\mu A\ cm^{-2}$, depending on the applied potential difference and the time required to reach steady state. The measured currents result from electrolysis of water. Bubble formation was not observed because current densities were kept below 1 $mA\ cm^{-2}$. The electrolysis allows the $H_2$ and $O_2$ reaction products to be transported away from the electrodes and solubilized into bulk solution. Other electrochemical reactions may also contribute to the measured current, however these are negligible because similar results are observed using transparent gold (10 nm thick gold film vacuum deposited onto a glass microscope coverslip) and carbon electrodes. In the case of electrolysis, $H_3O^+$ and $OH^-$ ions are formed respectively at the anode and cathode electrodes via the following reactions:

$$3H_2O \rightarrow 2H_3O^+ + \tfrac{1}{2}O_2 + 2\ e^- \quad (1)$$

$$2H_2O + 2e^- \rightarrow 2OH^- + H_2 \quad (2)$$

With background electrolyte present in solution (e.g., due to dissolved $CO_2$), ionic conduction occurs primarily through electromigration of the electrolyte species. Provided the fluid remains motionless, electromigration of all dissolved ionic species will lead to a concentration build up of electrolyte near the electrodes—a process known in electrochemistry as concentration polarization. In the steady state situation, the polarizing effect of electromigration is balanced by diffusion and a steady concentration profile of electrolyte is established at each electrode. Accumulation of ions near the electrodes sets up a pressure gradient in the dilute suspension fluid, resulting from coulombic body forces which act on fluid regions which contain free charge. Given the planar symmetry of the anode and cathode electrodes the induced pressure gradient is completely uniform in the direction parallel to the anode and cathode electrodes. In such a geometry, once flow is nucleated at a point of non-uniformity on the surface of electrode, convective flow patterns will occur in the cell. An example of this occurs during electroplating reactions, where convective currents are frequently observed and result in patterned blemishes on the plated surface. Convective fluid flow is nucleated by the presence of colloidal particles, which disrupt the planar symmetry of the concentration polarization process occurring at the electrode. Lateral variations in the amount of concentration polarization induce a spatially varying "free charge" and the action of the free charge induces fluid motion. Once fluid motion is initiated, the free charge density near the electrodes will also be influenced by convective motion resulting in complicated flow patterns that agglomerate particles. Such flow patterns would be expected to attract particles together via a hydrodynamic interaction. Such an electrohydrodynamic attraction fits the observed long range nature of the lateral attractive force, and also explains why like-charged particles are attracted towards one another.

The existence of fluid flow was verified by experiments which were performed with patterned electrodes. An electrode step may be formed by etching away the conductive ITO layer on one side of the step while masking the other side with an etch resistant polymer that was later removed with a solvent wash. Given that one side of the step is conducting and the other side is insulating, when an electric field is applied to this electrode, a lateral current gradient is set up across the electrode step that is approximately 5 $\mu$m in width. The electrode step geometry may thus be roughly thought of as a 1-dimensional analogue of the current gradient expected around a spherical colloidal particle. Current gradients around colloidal particles on the electrode surface occur because conducting ions are required to flow around the insulating particle.

To observe the effect of 1-dimensional current gradients, an identical experiment to that shown in FIG. 2 was performed with particles evenly distributed on either side of the electrode edge. Upon application of the field, particles on the non-conducting side of the electrode were immediately observed to move towards the electrode edge. This "lateral" motion is extremely long-ranged and was observed to occur at macroscopic distances (1–2 mm) from the electrode edge. Such motion can be induced with both DC and AC fields and particle velocities, of the order microns per second, may be controlled by field strength or frequency. For frequencies above 1 MHZ, no motion occurs. On the conducting side of the electrode, particle agglomeration to form crystals is observed to occur in an identical manner to that shown in FIG. 2. The long-range particle motion results from electrohydrodynamic convective fluid flow induced within the cell. To test this hypothesis, and visualize the flow, 2 $\mu$m polystyrene particles were dispersed in the bulk solution and evenly distributed on either side of the electrode step. A small fraction of particles were allowed to settle on the substrate at which time a 1 kHz, 10 V, AC field was applied to the cell. As particles near the substrate began to move, the focal plane of the microscope was translated into the solution to enable visualization of particle motion in bulk solution. At these field frequencies, the particles do not undergo electrophoretic motion and are only influenced by Brownian and convective forces. They thus act as tracers to illustrate fluid motion. A convective flow pattern is established in the cell with fluid swept towards the gradient in ionic current at the electrode step, up into the bulk solution and then re-circulated. Visualization of this flow provides direct evidence of fluid flow induced by the electrohydrodynamic mechanism described above.

Externally modulating the magnitude of the lateral attractive force between electrophoretically deposited particles enables the controlled assembly of highly ordered mono- and multilayers. FIGS. 4*a–f* and 5*a–f* illustrate two assembly procedures whereby external modulation of the lateral attraction force is utilized to form ordered films. In FIG. 4*a–f,* which uses a dc field, the total number particles dispersed in the cell is far greater than the required to form a monolayer. The electric field is adjusted so that the rate of arrival of particles through electrophoretic deposition, $R_E$, is slow relative to the rate of lateral motion of particles towards other particles on the surface, $R_L$, due to the lateral attraction force. $R_E$ depends mainly on the particle charge and magnitude of the electric field in the bulk solution; $R_L$ depends mostly on the current density passing through the particle layer.

Figure 4A:
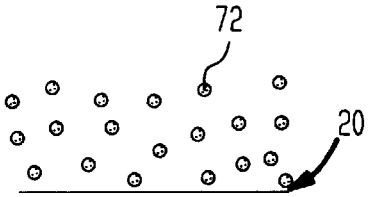
FIGS. 4 *a–f* show a method of assembling colloidal particles into ordered multilayers using a dc field.
Figure 4B:
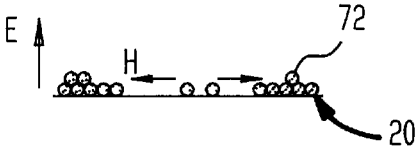
Figure 4C:
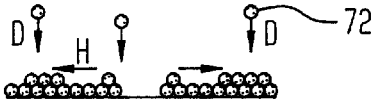
Figure 4D:
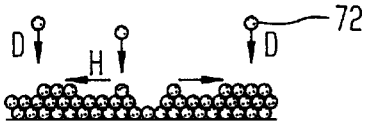
Figure 4E:
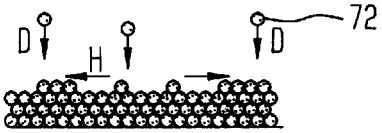
Figure 4F:
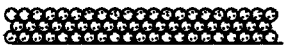
Figure 2A:
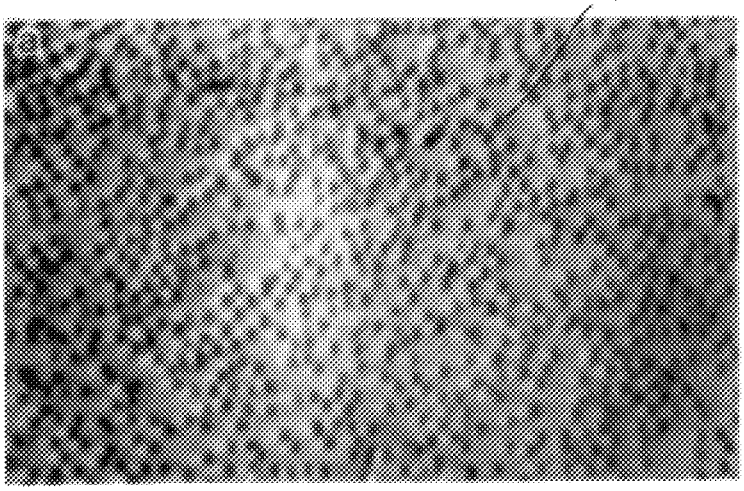
FIGS. 2 *a–f* show examples of crystal formation by the method of the present invention.
Figure 2B:
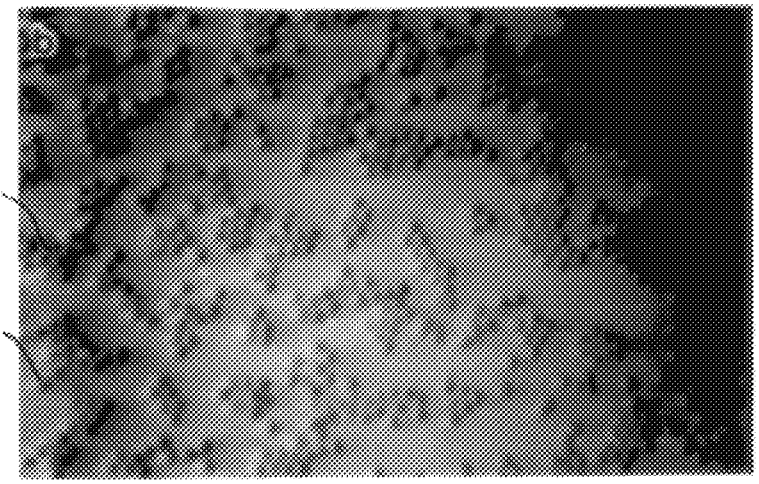
Figure 2C:
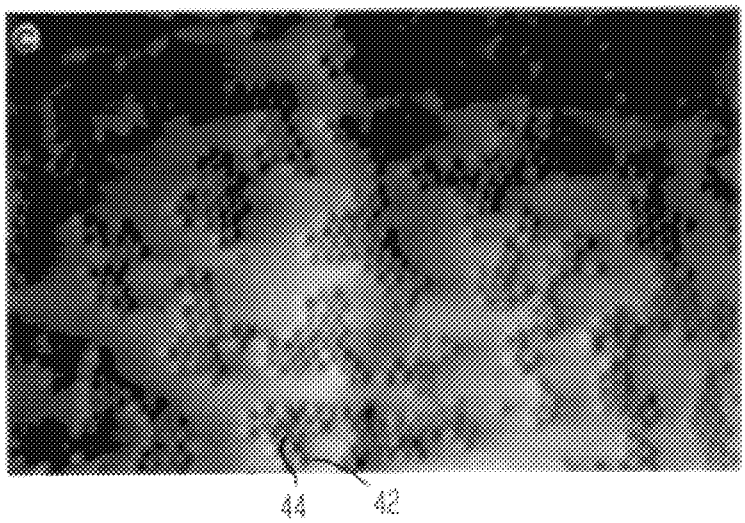
Figure 2D:
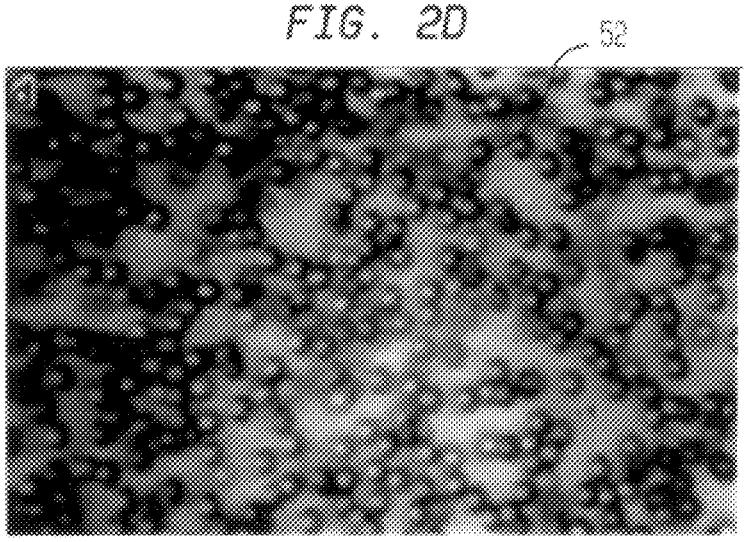
Figure 2E:
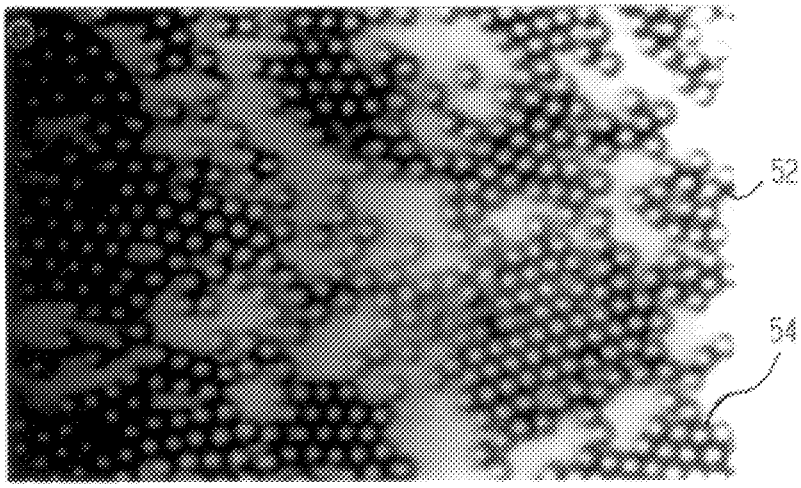
Figure 2F:
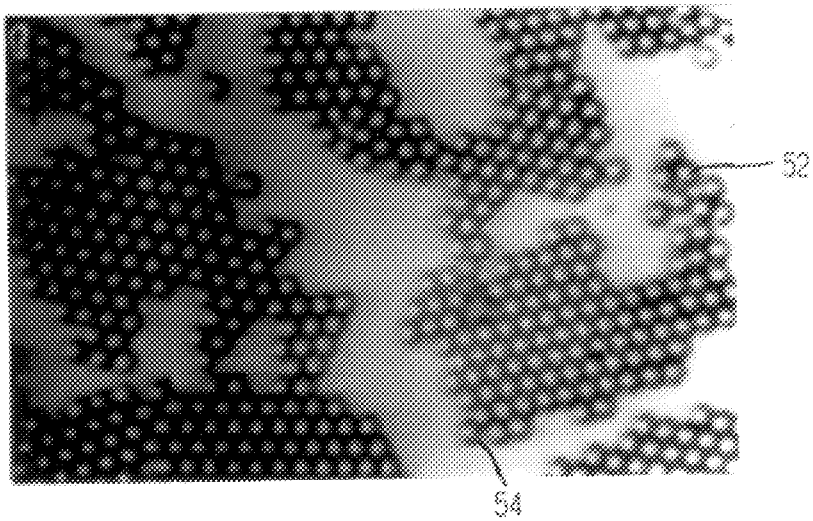

FIG. 4*a* shows particles 72 dispersed in a cell over anode electrode 20. FIG. 4*b* shows a DC electrical field E applied to the cell resulting in electrophoretic deposition of particle 72 to the anode electrode 20. As shown in FIGS. 4*c*, 4*d* and 4*e*, this process is repeated by depositing more particles 72, electrophoretically depositing the particles shown by arrow D and allowing the particles to electrohydrodynamically form clusters along the direction of arrows H. As shown in FIG. 4*f* the particles are allowed to coagulate and then the excess particles are rinsed to form a layered crystalline structure.

When $R_L \geqq R_E$, particle layers are formed by a "step growth" mechanism whereby small crystal aggregates grow at edges, or steps, by laterally attracting particles which arrive at the surface. In the same manner, highly ordered multilayered films may be grown with large ordered domains. FIG. 6 shows a three-layer film of PS particles, assembled in ~40 min. at 2 V. Manipulation of the $R_L/R_E$ ratio, that is, changing the "quenching rate" of the assembly process, controls the size of the domains allowing formation of a variety of packing geometries, from amorphous to highly crystalline. Similar multilayered structures have been formed with the 900 nm diameter silica particles shown in FIG. 2.

Once the crystalline structures are formed, the structures may be permanently "frozen" into place by inducing controlled coagulation with the applied field. For example, by applying a strong DC voltage (>2 V) the particles can be coagulated and permanently adhered to the anode electrode. By applying a high amplitude AC voltage (e.g., 1 kHz, 3 V), the colloidal particles experience no net electrophoretic force pushing them towards the electrode, however the colloidal particles are strongly pushed together by the lateral attraction force described above. The result in the AC case is a lateral coagulation of the particles with each other, but with little or no adhesion to the anode electrode. Such a method of controlled coagulation allows for the subsequent removal of a coagulated sheet of colloidal material, either electrophoretically, by reversing the polarity of the electrodes, or by flow induced shear. The layered structure shown in FIGS. 6*a–c* was coagulated by leaving the applied voltage at 2 V for 12 hours after the multilayer was assembled. Coagulation of the first layer onto the electrode surface is achieved relatively quickly (<1 minute for voltages >V), however coagulation of higher layers is more difficult and requires higher applied voltages and longer coagulation times.

Figure 5A:
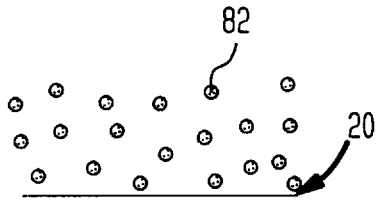
FIGS. 5 *a–f* show a method of assembling colloidal particles into ordered multilayers using an ac field.
Figure 5B:
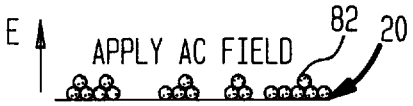
Figure 5C:
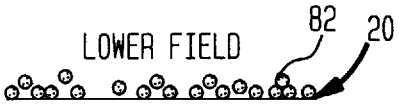
Figure 5D:
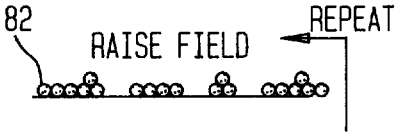

Another method of monolayer assembly is shown in FIG. 5*a–f.* This method is particularly suited for the sequential assembly of multi-layered colloidal structures with alternating composition. For this method, the exact number of particles 82 required for a fully dense monolayer are introduced in solution as shown in FIG. 5*a* and are electrophoretically deposited randomly onto the anode electrode 20 into an arrangement as shown in FIG. 5*b*. Next, the strength of the applied field is lowered until Brownian motion begins to fluidize the colloidal layer, i.e., until the two-dimensional crystal structures in the first layer begin to melt and form either liquid or gaseous structures as shown in FIG. 5*d*. After allowing the particles to randomize by Brownian motion, the applied voltage is raised until all the particles in the first layer crystallize. At this point, a certain number of particles which were previously in the second layer have now been transferred to the first layer and a new crystal structure is formed.

Figure 5E:
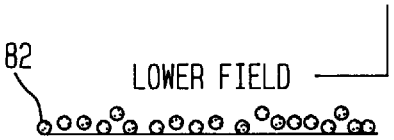
Figure 5F:
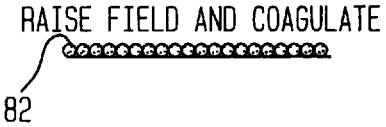

This process is now repeated until all of the particles in the second, or higher layers, have successively been transferred to the first layer, see FIG. 5*e*. For the 2 $\mu$m polystyrene particles described above, this is usually achieved by applying an offset, low frequency AC voltage (e.g., 0.02 Hz, 0.2–2 V peak to peak) for a period of approximately 20 minutes until a uniform monolayer structure is formed as shown in FIG. 5*f*.

Figure 6A:
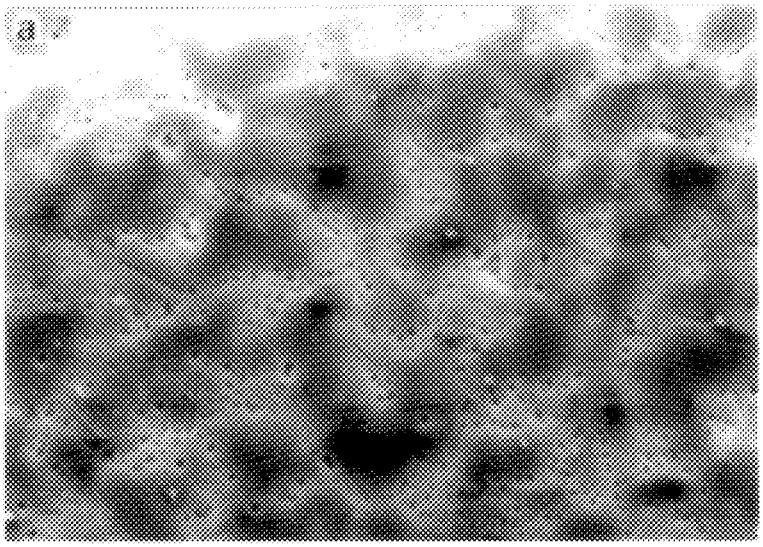
FIGS. 6 *a–c* shows a three-layer film of PS particles assembled by the method and apparatus of the present invention.
Figure 6B:
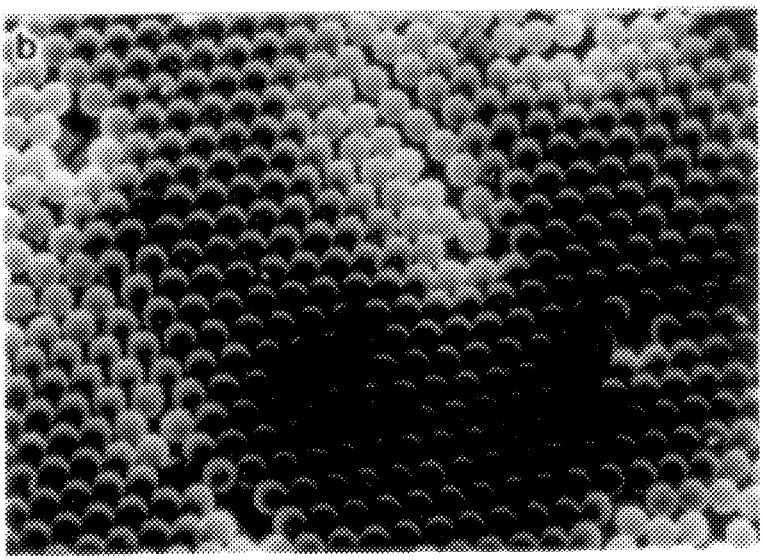
Figure 6C:
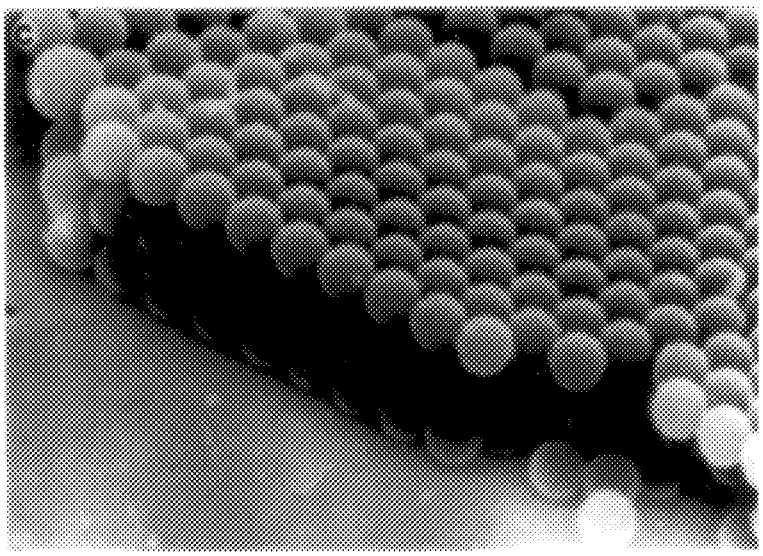

These monolayers have similar packing geometries to that shown in FIG. 6*a–c,* typically with smaller grain sizes because of the many randomizing steps. The procedure, "field-induced annealing," has the effect of sequentially melting ("shaking") and freezing the crystallized colloidal layer until all of the particles are present in the required packing arrangement. The duration of the shaking step compared to the duration of the freezing step determines the grain size of the two-dimensional crystals in the monolayer. A large range of single layer morphologies, from amorphous to highly crystalline, can thus be formed by manipulating the applied voltage signal during the field-induced annealing step. Once the colloidal monolayer is formed, it can be frozen into place by inducing coagulation with the applied field. At this point, another batch of particles (these can be different particles from those in the first layer) can be introduced into the chamber to form a second layer.

Alternatively, a fresh electrode can be formed by electroplating a metal layer on top of the coagulated colloidal monolayer. Once a fresh conducting surface is formed, the entire process can potentially be repeated an infinite number of times, allowing the construction of alternating metal/ceramic multilayers with controlled structure. This method of forming densely packed colloidal layers is by no means restricted to silica, polystyrene and gold. Indeed, provided that the colloidal stability of the depositing particles is maintained at the electrode, it should be possible to deposit any colloidal material via this method in a controlled manner.

The fluid motion of the particles arises as a result of coulombic body forces acting on "free charge" generated in solution. Electrohydrodynamic flow in a system can also be predicted. Choosing the simplest system, namely an electrochemical cell with uniform current density, j, across two parallel electrodes under the condition of steady state (i.e., a system where j remains constant with time), and assuming that ionic conduction occurs primarily through the electromigration of background electrolyte species (e.g., due dissolved $CO_2$), with electrode reactions being those described in equations (1) and (2). Provided the fluid remains motionless, the concentration field of each ionic species in solution may be determined from the approach of V. G. Levich, Physicochemical Hydrodynamics, Prentice-Hall, Englewood Cliffs, N.J., 1962. If only the anode electrode 20, is considered, three types of ionic species are distributed in the solution with concentrations $C_1$, $C_2$ and $C_3$. $C_2$ and $C_3$ represent concentrations of cationic and anionic background electrolyte species and $C_1$ is the concentration of $H_3O^+$ ions formed by the electrode reaction. For the sake of simplicity, all ions will be considered to be monovalent. The ion motion occurring through a mixture of electromigration and diffusion, and ion flux equations may be written in the following manner:

$$j = D_1F\frac{\partial C_1}{\partial y} + \frac{D_1F^2}{RT}C_1\frac{\partial o}{\partial y} \tag{3}$$

$$o = D_2F\frac{\partial C_2}{\partial y} + \frac{D_2F^2}{RT}C_2\frac{\partial o}{\partial y} \tag{4}$$

$$o = D_3F\frac{\partial C_3}{\partial y} + \frac{D_3F^2}{RT}C_3\frac{\partial o}{\partial y} \tag{5}$$

where o represents the electrostatic potential at a distance y from the electrode, $D_k$ is the diffusion coefficient of the k-th ionic species in solution and R, T and F are respectively the universal gas constant, temperature and Faraday's constant. In order to solve these equations simultaneously the condition of electroneutrality is initially imposed, i.e., $$C_1+C_2-C_3=0 \tag{6}$$

Solution of equations (3)–(6) gives the following expressions for local electrolyte concentration:

$$C_2=C_2^{(0)}e^{-\Psi} \tag{7}$$

$$C_3=C_3^{(0)}e^{\Psi} \tag{8}$$

$$C_1=C_3-C_2 \tag{9}$$

where $\Psi(=F/RT)$ is the dimensionless electrostatic potential in solution, and $C_2^{(o)}$ and $C_3^{(o)}$ respectively represent the concentrations of cationic and anionic background electrolyte at the electrode surface. Selecting the potential at the electrode (i.e., at the plane y=0) to be zero, the following is obtained:

$$\Psi = 1n\left(1+\frac{y}{\beta}\right) \tag{10}$$

where $$\beta = \frac{2D_1C_3^{(0)}F}{j}$$

represents the effective thickness of the concentration polarization layer. The free charge distribution in the solution, $\rho_e$, may thus be determined from Gauss' Law $$\rho_e = -\epsilon_0\epsilon\nabla^2\Psi = \frac{\epsilon_0\epsilon RT}{F}\quad\frac{1}{(\beta+y)^2} \tag{11}$$

where $\epsilon_0$ stands for the permitivity of free space and $\epsilon$ is the local dielectric constant.

According Landau and Lifshitz, in the presence of an applied electric field, the electric force density acting on a fluid, in rationalized units, is given by $$f_e = \frac{1}{2}\nabla\left[\epsilon_0\rho\left(\frac{\partial\epsilon}{\partial\rho}\right)_T E\cdot E\right] - \frac{1}{2}\epsilon_0 E\cdot E\nabla\epsilon + \rho_e E \tag{12}$$

where E is the local field and $\rho$ is the mass density. The first term in this equation is the gradient of a scalar and can be absorbed into the pressure, and for the present system, $\nabla\epsilon=0$. Thus, fluid motion results solely from the Coulombic, $\rho_e$ E, body force in equation (12) and may be described by solutions of the Stokes equations, modified to incorporate this additional force. Namely, $$0=-\nabla p+f_{e+}\mu\nabla^2 u \text{ and } \nabla\cdot\mu=0 \tag{13}$$

where p represents hydrostatic pressure, $\mu$ is viscosity and u is the fluid velocity. For the parallel electrode case with static fluid, equation (13) reduces to $\nabla p=\rho_e$ E, which may be solved to give an expression for the pressure field in solution:

$$p = \frac{\epsilon_0\epsilon R^2T^2}{2F^2}\left[\frac{1}{\beta^2}-\frac{1}{(y+\beta^2)}\right] \tag{14}$$

Provided the fluid remains motionless, and provided that j is uniform across the electrode surface and remains constant with time, equation (14) is applicable.

During electrophoretic deposition, current gradients across the electrode surface develop because of the shielding effect of particles. Particles obstruct the motion of conducting ions forcing them to be transported around their boundaries. The net effect of the particles may thus be modeled by lateral current gradients on the surface of the electrode. An example of this is where the current density, $j_1$, flowing between two particles is smaller than the current density, $j_2$, far away from the two particles. As a first estimation of the fluid velocity resulting from this gradient in j, equation (14) may be used to predict the pressure fields generated at these two points on the electrode, given expected values for $j_1$ and $j_2$. Assuming stokes flow, with a no-slip boundary condition for fluid motion parallel to the electrode, and substituting physically reasonable values for distances (5 $\mu$m) and $\Delta y$ (1 $\mu$m) the following expression for fluid velocity is obtained for a distance of 1 $\mu$m from the electrode surface:

$$u = \frac{\epsilon_0 \epsilon R^2 T^2}{2\mu F^2} \frac{\Delta y^2}{\Delta x} \left[ \frac{1}{\beta_1^2} - \frac{1}{\beta_2^2} - \frac{1}{(\beta_1 + y)^2} + \frac{1}{(\beta_1 + y)^2} \right] \tag{15}$$

where $\beta_1$ and $\beta_2$ represent the concentration polarization thickness at two points on the electrode surface having current densities $j_1$ and $j_2$ respectively. Values used for $D_k$, $\mu$ and $C_3^{(o)}$ are $10^{-10}$ $m^2s^{-1}$, $10^{-3}$ kg/ms and $10^{-3}$ mol $m^{-3}$ respectively. Relatively fast fluid motion can result from extremely small current gradients on the electrode surface. For example, a difference of 0.1% in current density can give rise to velocities of 27 $\mu$m $s^{-1}$. To predict fluid motion at the rate observed in experiments with patterned "step electrodes," a difference of only 0.1% in current density is required. The existence of such small current gradients is extremely feasible near any non-uniformities which exist on the electrode, for example, scratches, electrode edges, or electrophoretically deposited colloidal particles. Such large magnitudes for fluid velocity indicate the importance of electrohydrodynamic effects during electrophoretic deposition.

Close inspection of equation (15) reveals that for $y \gg \beta$, u is proportional $j_1^2 - j_2^2$. For $y \leqq \beta$, u is still proportional to $j_1^2 - j_2^2$ to leading order. This insensitivity of u to the sign of j suggests that the direction of fluid flow is independent of current polarity. This prediction is in accord with the observation of lateral fluid flow near electrode edges (FIG. 5) and particle aggregation with AC fields. An insensitivity of the direction of fluid motion to the polarity of the applied field is a characteristic of other electrohydrodynamic phenomena and distinguishes these from electrokinetic phenomena (such as electrophoresis) where motion always occurs in the direction of the applied field.

In order to calculate the velocity profile for flow induced by a current gradient across the electrode surface, a perturbation analysis was carried out on the equations presented above. The current density was assumed to vary periodically in 1-dimension over the surface of the electrode, i.e., $$j = j_0 + j_0 \delta e^{ikx} \tag{16}$$

where $j_0$ represents current density at a reference point on the electrode, x is distance along the electrode surface away from the reference point, $\delta$ is an arbitrary constant (<<1) and $k = 2\pi/\lambda$, where $\lambda$ is the wavelength of the oscillation. The concentration fields of electrolyte species, $C_i$, and the electrostatic potential, $\Psi$, can be represented as $$C_i = C_i^* + \delta f_i(y) e^{ikx} \text{ and} \tag{17}$$

$$\Psi = \Psi^* + \delta f_4(y) e^{ikx} \tag{18}$$

where $C_i^*$ and $\Psi^*$ represents values for the unperturbed case where $\nabla j = 0$, and are consequently given by equations (7)–(10). Since the problem is two-dimensional, a stream function, $\phi$, can be used represent the flow field in the following manner $$u_x = \frac{\partial \phi}{\partial x} \; ; u_y = -\frac{\partial \phi}{\partial y} \tag{19}$$

where $$\phi = \delta f_5(y) e^{ikx} \tag{20}$$

Here, $\phi^* = 0$ because no flow occurs without a current gradient. $f_1$, $f_2$, $f_3$, $f_4$ and $f_5$ are all functions which depend solely on y and describe the effect of the perturbation in equation (16).

Substitution of equations (17)–(18) into equations (3)–(6) gives four coupled differential equations which may be solved analytically for $f_1$, $f_2$, $f_3$ and $f_4$. These are obtained by collecting only terms of order $\delta$, and applying the boundary conditions of $f_2(0) = f_3(0) = (0)$. The following expression for $f_4$ results:

$$F4 = \frac{I}{k(\beta + y)} \left[ e^{-iky} - 1 \right] \tag{21}$$

Substitution of equations (20) and (21) into (13) gives a fourth order differential equation, $$F_5'''' - 2K^2 F_5'' + F_5 = \frac{K^2(2e^{-iKY} - 1)}{(1 + Y)^2} - \frac{2iKe^{-iKY}}{(1 + Y)^3} \tag{22}$$

where $K = k\beta$, $Y = y/\beta$ and $$F_5 = f_5 \left( \frac{F}{RT} \right)^2 \frac{\mu}{\epsilon_0 \epsilon}$$

are all dimensionless parameters. The particular solution of equation (22) was determined by the Variation of Parameters method, calculating the required integrals numerically. The following boundary conditions were applied, $F_5(0) = F_5(\infty) = F_5'(0) = F_5'(\infty) = 0$. Taking the real part of the general solution gives the fluid velocity, scaled on $$\left( \frac{RT}{F} \right)^2 \frac{\epsilon_0 \epsilon}{\mu \beta} \text{, as} \tag{23}$$

$$U_x = \delta \frac{\partial F_5}{\partial Y} \cos(KX) \text{ and}$$

where $X = x/\beta$ and $U_x$ and $U_y$ are dimensionless velocity components in the x and y directions respectively.

In conclusion, a new mechanism for colloidal attraction at electrode interfaces has been demonstrated. During electrophoretic deposition, particles are influenced by a long-ranged lateral attractive force strong enough to assemble the particles into two-dimensional crystalline aggregates. The lateral attractive force is a general phenomenon which occurs for any type of colloidal material located near an electrode surface, provided colloidal stability is maintained. The force has been observed to operate on depositing particles ranging in size from 16 nm to 2 $\mu$m in diameter, and occurs with both DC and AC fields.

The origin of this force appears to result from an electrohydrodynamic mechanism in which gradients in current density, caused by the presence of particles near the electrode surface, generate localized fluid flow. Calculations based on this model accord with observed flow patterns near etched "step electrodes," where large convective cells are generated as a result of a 1-dimensional current gradient. External manipulation of the lateral attraction force, by varying either field strength or frequency, allows the reversible formation of a variety of two-dimensional colloidal states on the electrode surface, e.g., gaseous, liquid-like or crystalline states. Further manipulation of this lateral attraction facilitates the assembly of crystalline multilayers or more complicated "designed" structures. Once the required colloidal structures are assembled, they may be permanently frozen into place by controlled coagulation with the applied field. The simplicity of this assembly method, as compared to molecular vapor deposition techniques, makes this approach very attractive as a route to economically manufactured nanostructured materials. This method may also be suitable as a way assemble complex macromolecules such as proteins into two-dimensional crystals or other patterned configurations.

The present invention has numerous areas of applicability, including surface coatings. Eroding forces such as rusting, tarnishing or other undesirable chemical decomposition can be prevented by electrophoretically depositing inhibiting agents over the surface of the body or object to be protected. Once deposited, the macromolecular building blocks of the inhibiting agent can be electrohydrodynamically attracted to form evenly distributed monolayer covering the surface of the protective material. A composite layer of inhibitor could be manufactured by repeating the process with the same or different protectant.

Super conductivity is another area of application which may be realized due to the fact that the above described electrohydrodynamic method and apparatus makes it possible to position macromolecular building blocks in ways which would improve the conductibility of a composite material. By positioning different macromolecular building blocks and other nanosized particles about a composite conductor in particular locations, the electrical resistance to uniform electron travel may be significantly diminished. Accordingly, super conductive wires could be created.

DNA sequencing is also an area of application particularly well suited for the electrohydrodynamic manipulation of colloidal particulate matter. Using the techniques described above, particles with DNA strands can dispersed in a dilute suspension with fluorescent DNA tags wherein the tags bind with strands Thereafter, the particles can be attracted to the upper surface of an anode electrode by electrophoretic deposition. Once deposited, the ionic current passing through the suspension fluid stimulates the lateral attraction force to position the particles with the DNA strands and tags into an array. Thereafter, fluorescent light can be used to illuminate the fluorescent tags to reveal DNA patters which may be compared to established DNA patterns to determine the particular DNA sequence.

Liquid crystal displays (LCD's) is another area of application for the method and apparatus of the present invention. Existing LCD can only be clearly viewed when directly viewed. Should an LCD be obliquely viewed, the angular display of data is distorted or lost due to the geometrical shortcomings of its electronic configuration of each LED cell. This is a drawback that is readily noticed in LCD computer displays. This drawback can be overcome with the use of a two dimensional array of particles which, when activated, would form a cluster and block light from passing through a cell, and when released, would be dispersed in a fluid.

Having thus described the invention in detail, it is to be understood that the forgoing description is not intended to limit the spirit and scope thereof. What is desired to be protected by the Letters Patent is set forth in the appended claims.

What is claimed is:

1. A method of electrohydrodynamically constructing crystals comprising the steps of:

providing an electrolytic cell having a cathode electrode, an anode electrode and a space therebetween;

placing a fluid with suspended particles between the cathode and anode electrodes;

applying a first electric field between the cathode electrode and the anode electrode sufficient to deposit the suspended particles on the anode electrode; and then applying a second electric field that is stronger than the first electric field and is sufficient to cause the deposited particles on the anode electrode to laterally move towards each other to form a cluster of particles on the anode electrode; and then applying a third electric field that is stronger than the second electric field and is sufficient to cause the particles in the clusters to permanently adhere to each other to form a permanent crystalline structure.

2. The method of claim 1, wherein the first electric field is a weak electric field.

3. The method of claim 1 wherein the first electric field is increased to the second electric field by increasing the voltage between the electrodes and the second electric field is increased to the third electric field by increasing the voltage between the electrodes.

4. The method of claim 1 further comprising the step of removing the crystalline structure from the anode.

5. The method of claim 4, wherein the step of removing the crystalline structure comprises the step of reversing the polarity between the cathode electrode and the anode electrode.

6. The method of claim 1, further comprising after forming the permanent crystalline structure:

placing a second fluid with second suspended particles between the cathode and anode electrodes; and applying another electric field between the cathode electrode and the anode electrode sufficient to deposit the second suspended particles on the permanent crystalline structure to form a composite crystalline structure.

7. The method of claim 6, further comprising after forming the composite crystalline structure:

placing a third fluid with third suspended particles between the cathode and anode electrodes; and applying yet another electric field between the cathode electrode and the anode electrode sufficient to deposit the third suspended particles on the composite crystalline structure to form another composite crystalline structure.

8. The method of claim 1, further comprising before applying the third electric field, reducing the second electric field sufficient to permit the clusters to separate into suspended particles and then increasing the electric field to at least the second electric field to cause the deposited particles on the anode electrode to laterally move towards each other to again form a cluster of particles on the anode electrode.

9. The method of claim 1 wherein at least one of the electrodes is patterned for forming a patterned structure.

* * * * *